US005142978A

United States Patent [19]

Borel

[11] Patent Number: 5,142,978

[45] Date of Patent: Sep. 1, 1992

[54] OFFSET PRINTING MACHINE FOR VARIABLE PRINTING SIZES WITH AUTOMATIC LOADING AND UNLOADING OF THE PRINTING CYLINDERS

[75] Inventor: Edouard Borel, Corcelles-Sur Chavornay, Switzerland

[73] Assignee: Bobst SA, Switzerland

[21] Appl. No.: 689,504

[22] Filed: Apr. 23, 1991

[30] Foreign Application Priority Data

Apr. 25, 1990 [CH] Switzerland ..... 01402/90

[51] Int. Cl.[5] ..... B41F 13/44; B41F 31/30

[52] U.S. Cl. ..... 101/177; 101/352

[58] Field of Search ..... 101/216, 219, 212, 181, 101/152, 153, 247, 177, 182, 184, 185, 351, 352, 148, 207-210, 479, 480

[56] References Cited

U.S. PATENT DOCUMENTS 2,557,381 8/1946 Huebner ..... 101/180
3,610,144 10/1971 Woessner ..... 101/216
4,616,564 10/1986 Faddis et al. ..... 101/143
4,807,526 2/1989 Troyer ..... 101/216
5,060,569 10/1991 Gladow ..... 101/181

FOREIGN PATENT DOCUMENTS 1169959 5/1964 Fed. Rep. of Germany .
2443930 7/1980 France .

*Primary Examiner*—J. Reed Fisher
*Attorney, Agent, or Firm*—Hill, Van Santen, Steadman & Simpson

[57] ABSTRACT

An offset printing machine is disclosed wherein printing cylinders used for a new run are carried by a carriage into a vicinity of a printing unit of the machine. The printing unit is provided with two lateral movable arms which automatically and successively transfer every printing cylinder from the printing unit onto the carriage and inversely, the new cylinders from the carriage onto the printing unit.

21 Claims, 11 Drawing Sheets

OFFSET PRINTING MACHINE FOR VARIABLE PRINTING SIZES WITH AUTOMATIC LOADING AND UNLOADING OF THE PRINTING CYLINDERS

BACKGROUND OF THE INVENTION

The present invention concerns the offset printing of webs with variable sizes.

FIG. 1 of the attached drawing represents a simplified diagram illustrating the operation of an offset printing machine comprising:

a cylinder PP carrying a metal plate P on which the image is engraved;

a cylinder PB carrying a rubber plate called a blanket B and destined to transfer the image by means of an ink film on the corresponding area of what will hereafter be called a travelling web F of a cardboard or similar matter;

a counter-cylinder CC destined to press the web F against the cylinder PB;

an inking unit E comprising an ink roller $E_1$ with adjustable doctor blades, a dipping roller $E_2$, distributing rollers $E_3$, and inking rollers $E_4$; and a moistening unit M (for water or alcohol) comprising a basin $M_1$, a dipping roller $M_2$, distributing rollers $M_3$, and moistening rollers $M_4$.

If an offset machine is to be used to the maximum of its potential, it is an established fact that the three cylinders PP, PB, and CC are to have an identical perimeter corresponding to the length of the printing size.

When unrolling over the advancing web F, the plate P of the cylinder PP will transfer one or several print motifs contained within the limits of the entire printing size, and corresponding to a future package. So, for instance, in the event of large washing powder boxes having to be printed, one print might correspond to a circumference of the cylinder or to a printing size (the dead area used for fastening the plates and blankets being deducted); on the other hand, with liquid boxes, several print motifs will be necessary to ensure the entire cylinder revolution. However, when printing, this difference will only enter into account if, at a further stage, the printing size is cut into several parts or blanks whereupon every single motif will be destined to a single package. Consequently, every new run, with a size length different from the preceding one, requires the exchange of the three cylinders PP, PB, CC. Considering that a printing machine might consist of up to ten cylinder assemblies PP, PB, CC, i.e. one assembly for each color, this means that up to thirty cylinders will have to be exchanged for every new run. According to prior art, it is possible to fit the three cylinders for each run and the assembly into a cassette consisting of rigid frames, high-quality gears, crossbars, bearings, interaxial setting devices and the three cylinders PP, PB, CC (only the essential items being mentioned). With every changing size, the cassette will thus have to be exchanged on every printing unit.

The shortcomings of this procedure can be itemized as follows:

high expenses involved with every exchange;

considerable time required for preparing a new run, involving gear cutting, hardening, and polishing;

long down times caused by every exchange;

high investment frozen for storage.

SUMMARY OF THE INVENTION

It is an object of the present invention to optimally reduce both the labor and the time necessary for the loading and unloading of the printing cylinders in the event of size changes to be carried out on the offset printing machine.

According to the invention, a web-fed offset printing machine is provided for variable operating sizes wherein at least one printing unit is provided. A fixed lower frame supports the printing plate cylinder, blanket cylinder, and counter cylinder, the diameters of the cylinders varying with printing size. The three cylinders are arranged along a substantially vertical line and in a sequence in which the plate cylinder is in a top position. An upper movable cassette having at least an inking station with an associated ink well, dipping rollers, distributing rollers, and inking rollers is provided to be received by the lower frame such that when the cassette is in an initial lower position, a cassette will provide inking to a minimum size plate cylinder, and in a second upper position there is a sufficient set-off or space between the inking rollers and the plate cylinder to enable loading and unloading of the plate cylinder, blanket cylinder, and counter cylinder of a maximum permissible size. A movable means is fitted on both sides of the fixed lower frame for engagement with both ends of a central shaft of each of the cylinders for unloading them onto supporting bars situated in a downstream vacinity of the corresponding printing unit and for then engaging with ends of a central shaft of cylinders of a new printing size on the supporting bars and for loading them in place of the unloaded cylinders on the printing unit. The unloading and loading is fully controlled via a micro-processor.

DESCRIPTION OF THE PREFERRED EMBODIMENTS

Figure 1:
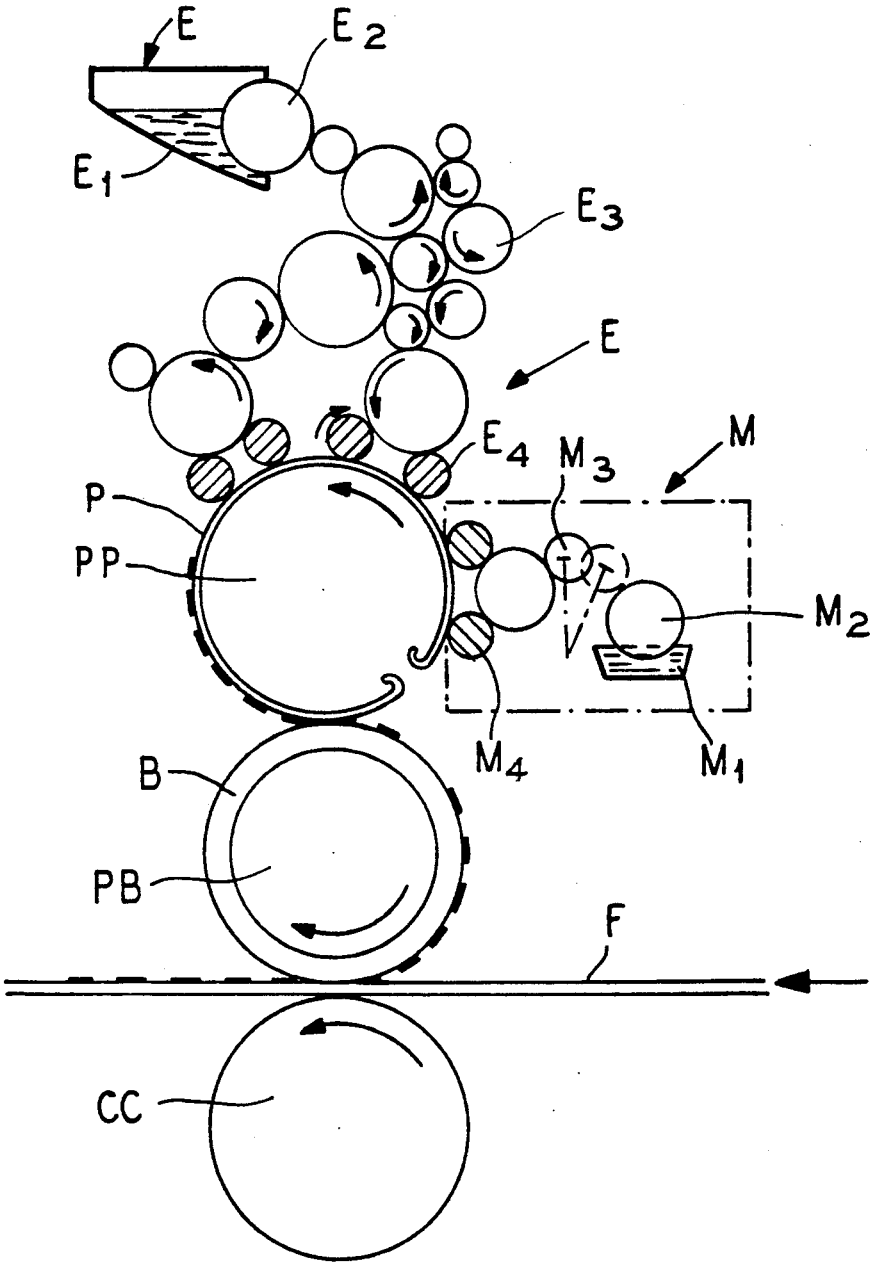
FIG. 1 (PRIOR ART)
FIG. 1 represents the operating diagram of an offset machine according to the prior art, as described above.
Figure 2:
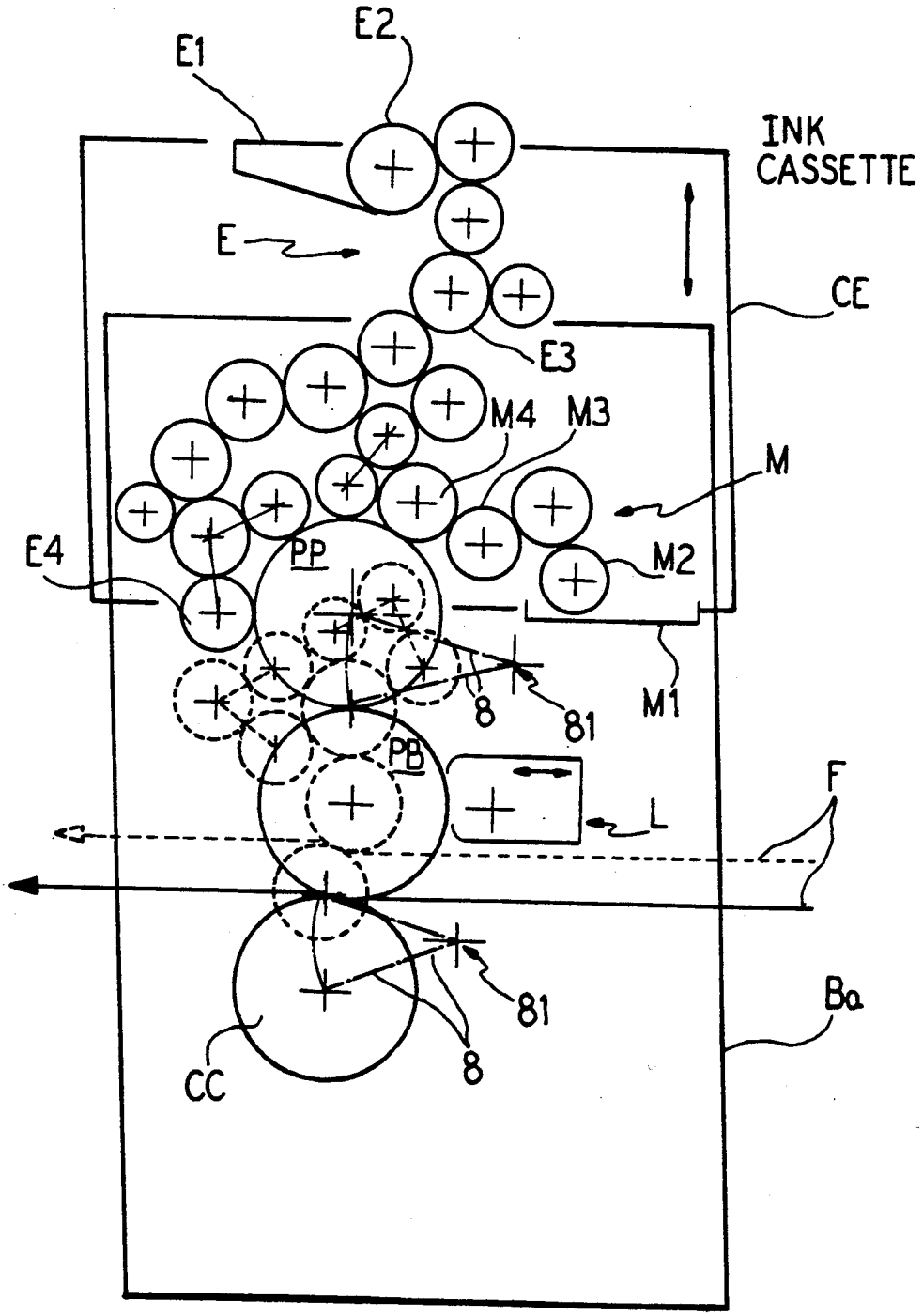
FIGS. 2 and 3 each represent a schematic side view of a printing unit of an offset machine according to the invention.

The offset printing machine illustrated by FIG. 2 thus includes, similar to what is shown by FIG. 1 described above, an upper plate cylinder PP, an intermediary blanket cylinder PB, a lower counter-cylinder CC, an inking unit E with its ink well $E_1$ and its rollers $E_2$–$E_4$, a moistening unit M with its basin $M_1$ and its rollers $M_2$–$M_4$, and a washing unit L (not represented on FIG. 1) of the cylinder PB.

The machine includes a lower part in the form of a fixed frame Ba and an upper vertically movable part called an inking cassette CE. Each end of the two cylinders PP and CC is fitted in rotary fashion on the first end of a tilting lever 8, 8' respectively, the second end of which is fitted in rotary fashion into the frame Ba on a horizontal axle 81, 81' with pretensioned bearings. On the other hand, the cylinder PB is fitted permanently with both its ends into the frame Ba. In this way, depending on the angular position of the tilting lever 8, 8', it is possible to put into operating position the cylinders PP and CC with different diameters proportionate to the length of the size to be printed. On FIG. 2, the cylinders PP, PB, and CC shown with continuous lines represent the maximum printing size, and the ones with dashed lines the minimum size.

The inking unit E and the moistening unit M with their respective components $E_1$–$E_4$ and $M_1$–$M_4$ are fitted immediately on the inking cassette CE. Among the distributing rollers $E_3$ or $M_3$, those shown with thick lines represent oscillating rollers. All inking rollers $E_4$ and moistening rollers $M_4$ are fitted on tilting levers. FIG. 2 also shows that owing to the vertical displaceability of the cassette CE and to the inking rollers $E_4$ or moistening rollers $M_4$ fitted on tilting levers, the inking and moistening units E and M may always take up a position allowing them to carry out their function of inking or moistening, whatever the dimensions of the cylinders PP, PB, and CC might be within the limits of the maximum and minimum sizes foreseen.

Figure 3:
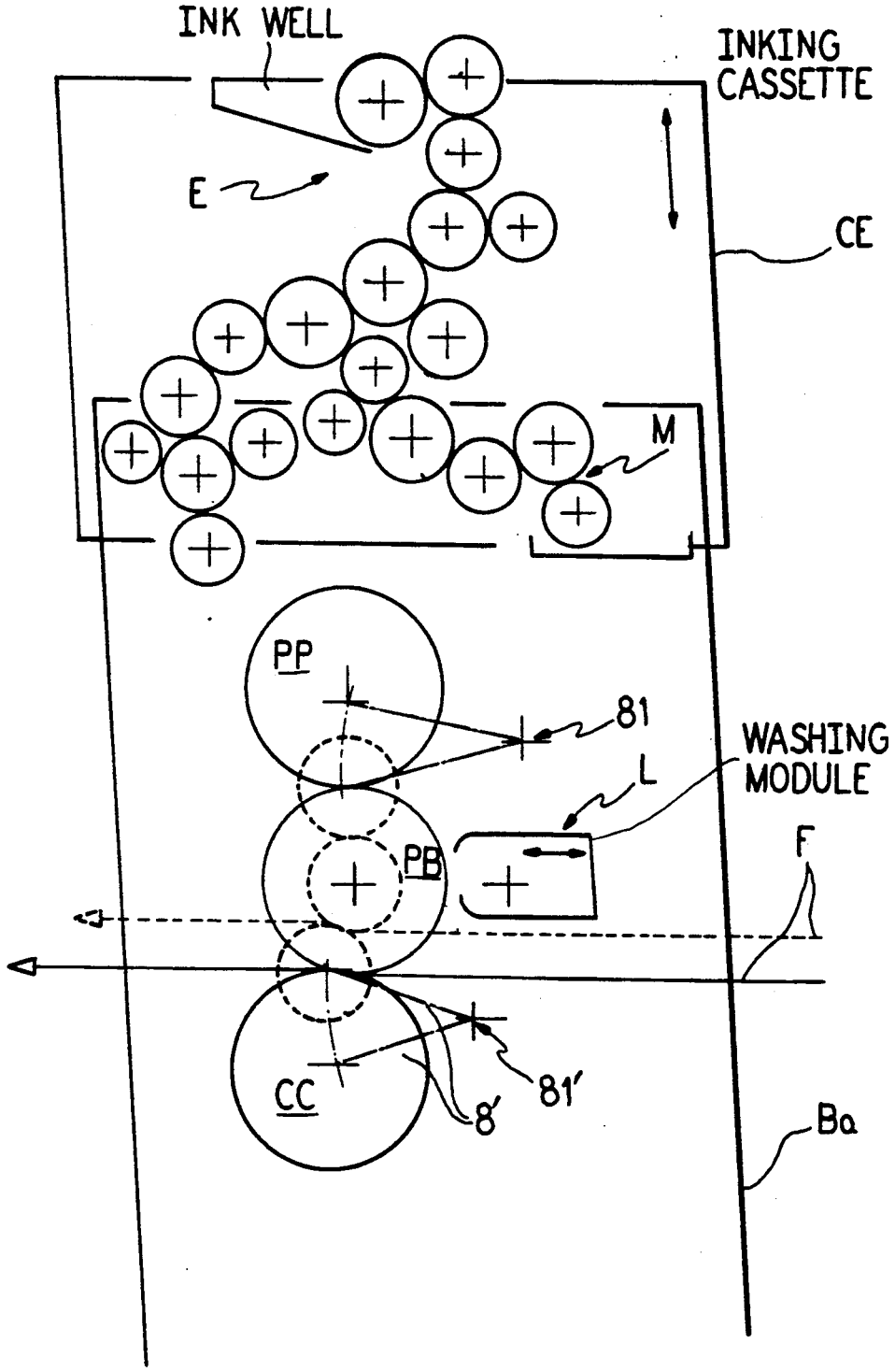

FIG. 3 shows the instant at which the cassette CE stands at its uppermost point so that the cylinder PP is fully disengaged from the printing rollers $E_4$ and the moistening rollers $M_4$ even in the event of the maximum size of the cylinders PP and PB being used (the cylinder CC has no influence). Considering that, as will be seen hereafter, this disengagement has the purpose of rendering the cylinder exchange easier, it has been noticed that with the cassette CE in its highest position, a distance of at least 50 cm was to be foreseen between the cylinder PP and the closest inking roller $E_4$ or the moistening roller $M_4$.

Figure 4:
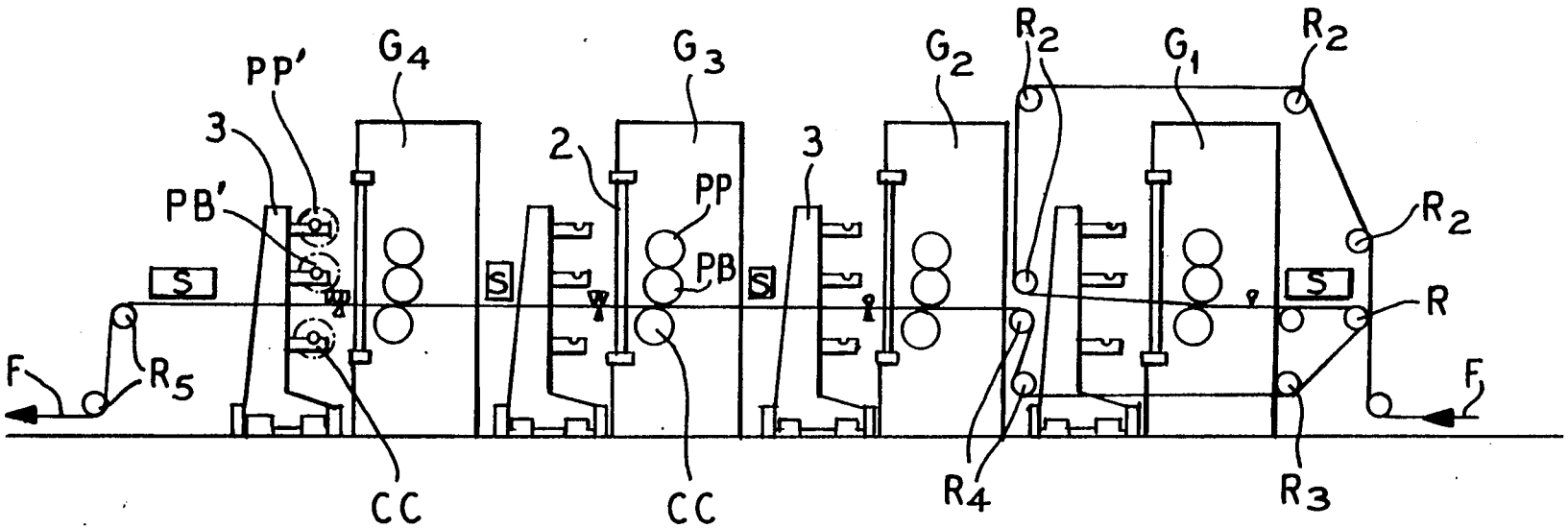
FIG. 4 is a schematic side view of an offset printing machine with four printing units.

In FIG. 4, four printing units $G_1$–$G_4$ each of which corresponds to an offset color, are crossed by the web F from right-to-left, it being understood, though, that the opposite, i.e. left-to-right, direction can also be envisaged. The first unit $G_1$ is foreseen for back-printing on the web F and the three other units $G_2$–$G_4$ for face-printing. For this purpose, it is envisaged to arrange guiding rollers $R_2$ around the first unit $G_1$ in order to guide the web F which is fed from the right-hand side over and from the rear of the unit $G_1$. This unit $G_1$ is then crossed from left to right so as to have the web face printed by the cylinder PB. Further guiding rollers $R_3$ will then deviate the web F downward through 180° whereupon it will run out from the first printing unit $G_1$ to be orientated again in the right-to-left direction, allowing it to be led through the base of the first printing unit $G_1$ towards the guiding rollers $R_4$ to be added to the second group $G_2$. Rollers $R_4$ are to be arranged so as to have the web F at the level and in the direction of the cylinder PB of the printing unit $G_2$. Then, the web F runs horizontally through the three printing units $G_2$–$G_4$. At the outlet of the machine, the web F is guided by the rollers $R_5$ towards a subsequent processing machine, for instance towards a sheeter. Attention is also to be drawn to the fact that the offset machine can also be provided with a web drying station S either at the outlet of the first printing unit $G_1$ for drying the back-print, at the outlet of the last printing unit $G_4$ for drying the face-print, or else between the printing units for a partial drying.

On either side of the web F as well as on the frame Ba of every printing unit $G_1$–$G_4$, vertical guides 2 are to support and guide the arms of the loading and unloading device of the cylinders PP, PB, and CC.

In the vicinity of every printing unit $G_1$–$G_4$, a free space allows the temporary positioning of a carriage 3 with the three printing cylinders PP', PB', CC' for the forthcoming exchange, i.e. for the new run, as shown by FIG. 4.

In other words, the carriage 3 is to carry the three exchange cylinders PP', PB', CC' from a storage place into a position perpendicular to the web and in the vicinity of the cylinders PP, PB, and CC which are operating. For this purpose, the carriage 3 (FIG. 7) comprises a base 31 with a length about equal to one of the printing cylinders, and of a vertical stay 32 connected to an end of the base 31. This base 31 is equipped with four pivotable wheels 33 enabling independent movements of the carriage 3. Grooves 34 allowing movements of the carriage 3 by means of a pallet transporter are also foreseen in the base 31. The carriage 3 includes three horizontal supports 35*a*, 35*b*, 35*c* vertically spaced and each destined to carry one of the three cylinders PP, PB, CC. Every horizontal support 35*a*–35*c* has at each of its ends a supporting bar 36 provided with an upward circular recess 36*a* serving as a seat for a free end of the central shaft 14 of a printing cylinder PP, PB or CC. In its upper part, the carriage 3 is provided with a frame 37 destined to facilitate manual handling. The vertical arrangement of the horizontal supports 35*a*–35*c* is such that the web F to be printed may horizontally pass between the lower support 35*a* and the intermediary support 35*b* before getting through the two cylinders PB and CC. Similarly, the lower support 35*a* and the base 31 provide between them a free space allowing the web F to travel through, for instance in the case of the printing unit $G_1$, on to FIG. 4. As may be gathered from FIG. 7, and with the web travelling through, i.e. with the offset machine operating, the downstream area of every printing unit $G_1$–$G_4$ allows the positioning of a carriage 3 by moving the latter perpendicularly to the travelling direction of the web F. As will result from FIG. 7, considering that it is not necessary to envisage the passage of the web F between the upper and intermediary supports 35*c* and 35*b*, the free ends of the latter supports are connected to one another for enhanced rigidity by means of a cross-bar 38 in a vertical position.

Figure 5:
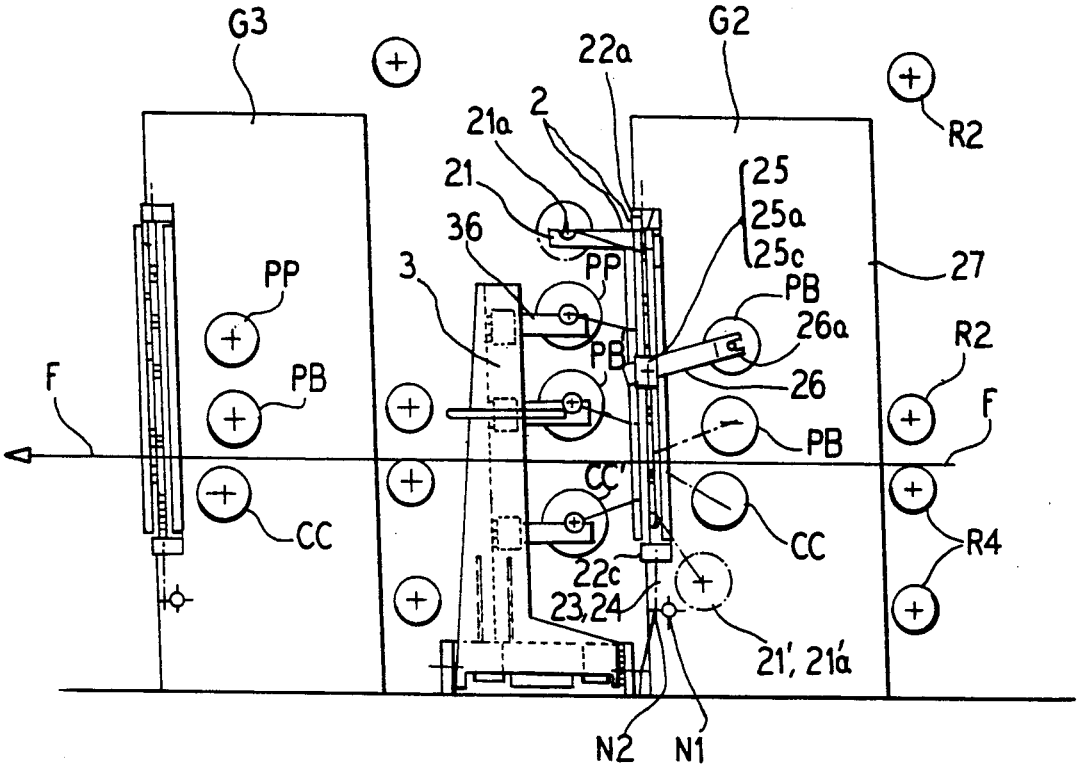
FIG. 5 is a schematic view of a part of the offset machine provided with a loading and unloading device for the printing cylinder.

FIG. 5 shows the second and third printing units $G_2$, $G_3$ with back-printing taking place on the web F. The following comments will provide a description of the loading and unloading of the printing cylinders PP, PB, CC of the second printing unit $G_2$, it being understood that the one or the other printing units $G_1$, $G_3$, $G_4$ is of identical design. FIG. 5 shows the exchange cylinders PP', PB', CC' arranged in the same order as the cylinders PP, PB, CC operating on the printing unit $G_2$, every exchange cylinder PP', PB', CC' having to take up the position of the corresponding cylinders on the printing unit $G_2$ and vice-versa. For this purpose, and as already mentioned above, both sides of the web F are to be controlled by the vertical guides 2 fitted on the lateral walls of the frame Ba on the printing unit $G_2$. Both guides 2 allow the sliding of a movable support 25 provided with a horizontal axle around which the first end of an arm 26 can pivot. The vertical motion of the support 25 is ensured by a ball-bearing supported screw 23, the upper and lower ends of which are fitted for free rotation on the bearings 22*a*, 22*c* respectively within the frame Ba of the printing unit $G_2$. The lower ends of the two ball-bearing supported screws 23 are connected to one another by transmission means (not represented) driven simultaneously by a common motor $N_1$. The ball-bearing supported screw 23 is linked with a corresponding not 25*a* as shown on the movable support 25 so as to shift the latter by rotating the ball-bearing supported screw 23. In this way, the user will obtain simultaneous and identical shifting and positioning of the two movable supports 25. Pivoting each arm 26 around the horizontal axle of the corresponding support 25 is achieved by means of a grooved shaft 24 of which the upper and lower ends are also fitted for free rotation on the bearings 22*a* and 22*c* within the frame Ba of the printing unit $G_2$. Similarly, the lower ends of the two grooved shafts 24 are connected with one another by transmission means (not represented) so that they can be rotated simultaneously and with the same speed by means of a common motor $N_2$. Inside the movable guide 2, well known prior art structure (not represented) permits the transformation of the rotation of the grooved shaft 24 into a tilting movement of the arm 26 around the horizontal axle mentioned above. The free end of each arm 26 is provided with telescopic grippers 26*a* whose opening and closing are controlled by pneumatic jacks.

Every gripper 26*a* has for its purpose the seizing of the free corresponding end of the central axle of one of the three printing cylinders PP, PB, CC. A horizontal auxiliary, fixed, crossbar 21 which is directed downstream is fitted at a first end on the frame Ba of the printing unit $G_2$ in the vicinity of the upper end of each guide 2, the free end being also equipped with an upward semi-circular recess 21*a*.

Figure 7:
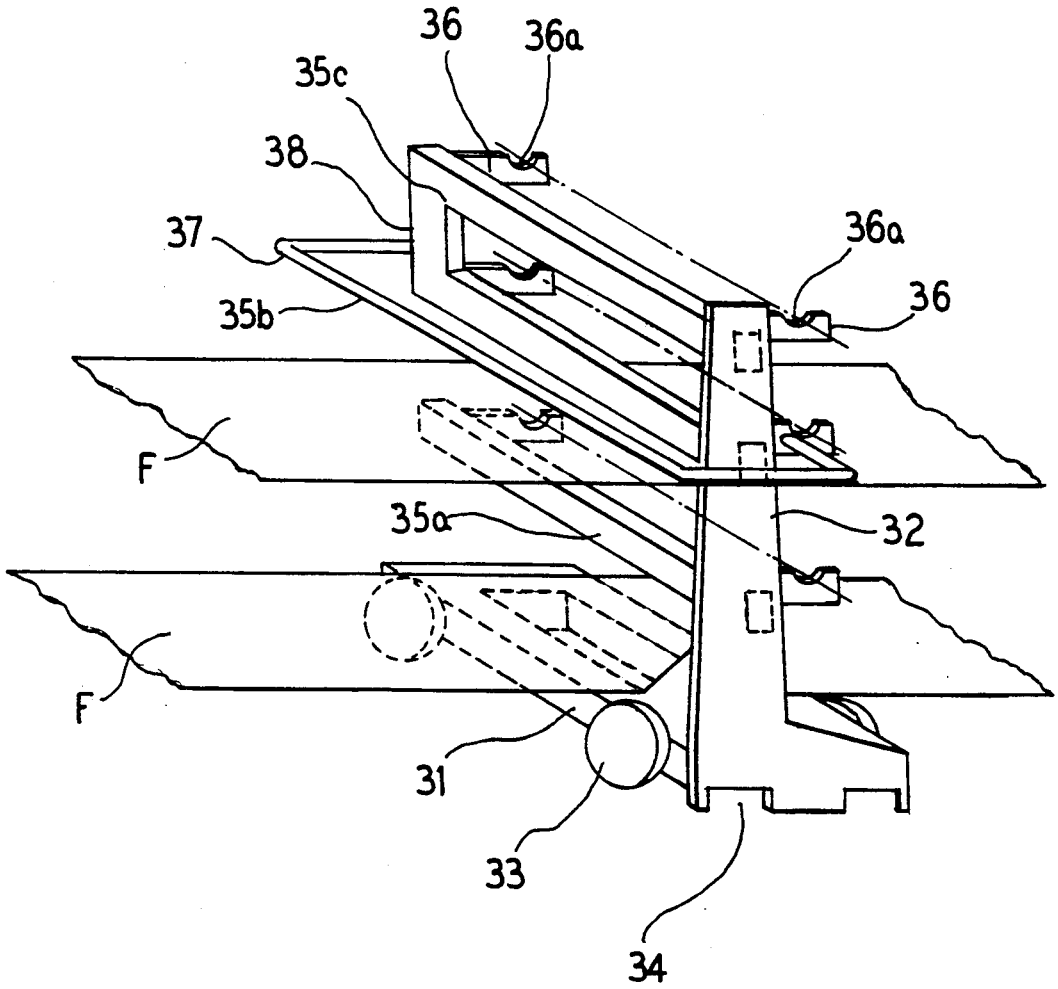
FIG. 7 is a simplified view of a printing cylinder loading and unloading carriage.

Loading and unloading (i.e. for instance exchanging) the cylinders PP, PB, CC for a smaller motif size operating on the printing unit $G_2$—shown in white on FIGS. 5 and 6 in place of the cylinders PP', PB', CC' for a larger motif size—shown in black on FIGS. 5 and 6 resting on the carriage 3) is achieved in the following way, the description hereafter being given only for one side since the other side is of identical construction. The free end of the arm 26 is moved into the vicinity of the central shaft 14 of the cylinder PP by appropriately shifting the movable support 25 and tilting the arm 26 so as to enable its gripper 26*a* to be connected with this very shaft 14. Once the shaft 14 of the cylinder PP has been seized by the gripper 26*a*, the latter will be closed by the pneumatic jacks mentioned above. Then, by shifting the support 25 upward and by also tilting upward the arm 26, the cylinder PP is moved into a position allowing its central shaft 14 to take a seat in the recess 21*a* of the auxiliary support 21. At this stage, the gripper 26*a* is disengaged from the central shaft 14 of the cylinder PP in order to be moved into the vicinity of the central shaft of the new large-size cylinder PP' resting on the carriage 3 by downward shifting of the movable support 25 and tilting of the arm 26. At this stage, the arm 26 can thus seize the cylinder PP' and put it in its place on the printing unit $G_2$. The following step of the unloading and loading process ensured by the arm 26 can be summed up as follows:

unloading of the cylinder PB by its transfer onto the supporting bar 36 of the upper support 35*c* on the carriage 3 (see also FIG. 7);

loading of the cylinder PB' by putting it in its place on the printing unit $G_2$;

unloading of the cylinder PB by its transfer onto the supporting bar 36 of the intermediary support 35*b* on the carriage 3;

unloading of the cylinder CC by its transfer into its intermediary standby position (represented in dashed lines on FIG. 5—even if these means are not represented, it is easy to understand that the components provided with recesses similar to the ones 21*a* of the auxiliary fixed support 21 can be envisaged for the frame Ba of the printing unit $G_2$ in order to hold the cylinder CC in its standby position);

loading of the cylinder CC' by putting it in its place on the printing unit $G_2$;

transfer of the cylinder CC from its standby position onto the supporting bar 36 of the lower support 35*a* on the carriage 3;

transfer of the cylinder PB from the supporting bar 36 of the upper support 35*c* onto the supporting bar 36 of the intermediary support 35*b*; and transfer of the cylinder PP from the auxiliary fixed support 21 of the printing unit $G_2$ onto the supporting bar 36 of the upper support 35*c* on the carriage 3.

Owing to an adequate curve describing ideally the way of loading and unloading of the cylinders PP, PB, CC, PP', PB', CC', the time necessary for loading and unloading can be reduced to a mere minimum. Similarly, the sequence of the cylinder shifts is indicated here only as an example; thus it is possible to fit the auxiliary fixed support 21 immediately on the upper end of the carriage 3 and to begin with putting the cylinder CC into a standby position to transfer the cylinder CC' on the unit $G_2$, and then the cylinder CC on the supporting bar 36 of the lower support 35*a*, and so on.

Fitting of the cylinders PP, PB, CC on the printing unit $G_2$ should obviously be done in such a way that every gripper 26*a* may be connected to a disengaged part of the central shaft 14 of the cylinders PP, PB, CC. Appropriate means are even to be foreseen for the disengagement of the central shaft 14 with respect to its rotary bearing fitted on the frame Ba of the printing unit, the means being likely to be more or less similar to those already used up to now for allowing a change of the printing size of such cylinders. Moreover, the way of fitting the cylinders PP and CC into the printing unit $G_2$ on tilting levers 8 and 8' respectively also allows them to be kept sufficiently apart from the fixed cylinder PB (even with large printing sizes) to thus render loading and unloading easier.

Quite obviously, all successive loading and unloading operations are controlled fully electronically by two previously programmed motors $N_1$, $N_2$, every movement being thus monitored and acknowledged so as to release the subsequent one and to ensure full safety.

Figure 6:
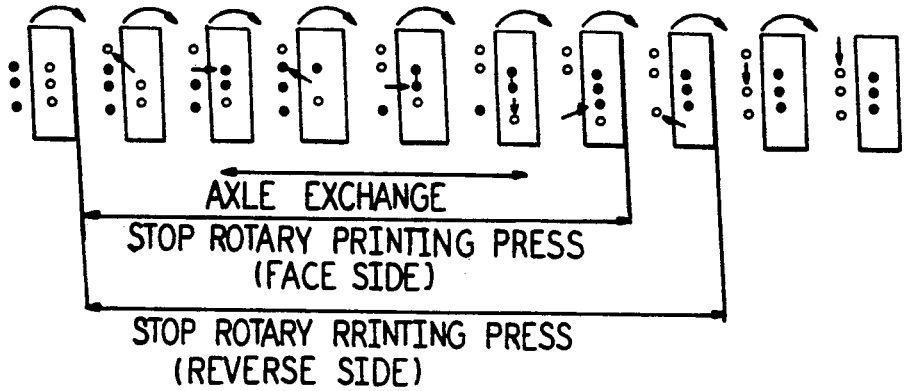
FIG. 6 is a functional diagram representing the various operational stages of the loading and unloading device according to FIG. 5.

FIG. 6 shows that there is no necessity to keep the offset printing machine at standstill until all successive loading and unloading phases will have been accomplished. Regarding the back-printing operation, the printing unit used for this purpose may begin to operate as soon as the three cylinders PP', PB', CC' for the new size will be positioned.

Also, obviously partial sequences, i.e. about 10 all together, are also foreseen, for instance the exchange of a single cylinder PP, of a single cylinder PB, or of the cylinders PP and PB, etc.

Such sequences are chosen automatically by checking the presence of the dash (') marked components when the carriage is put in, the checking being done by means of scanner heads, proximity switches, or the like.

Figure 8:
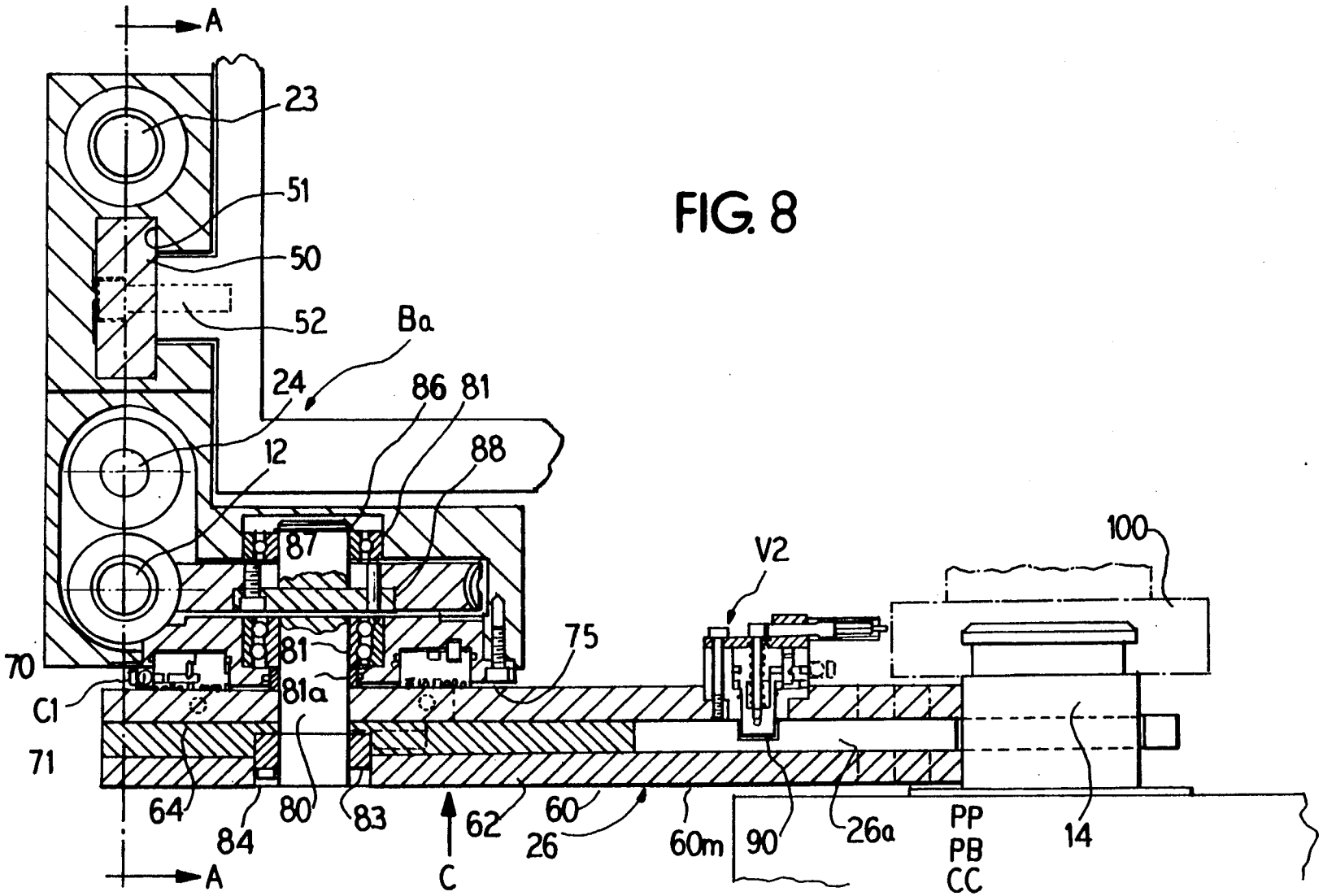
FIG. 8 is a partial sectional top view according to section line E—E of FIG. 9 of a printing unit provided with a printing cylinder loading and unloading device.
Figure 9:
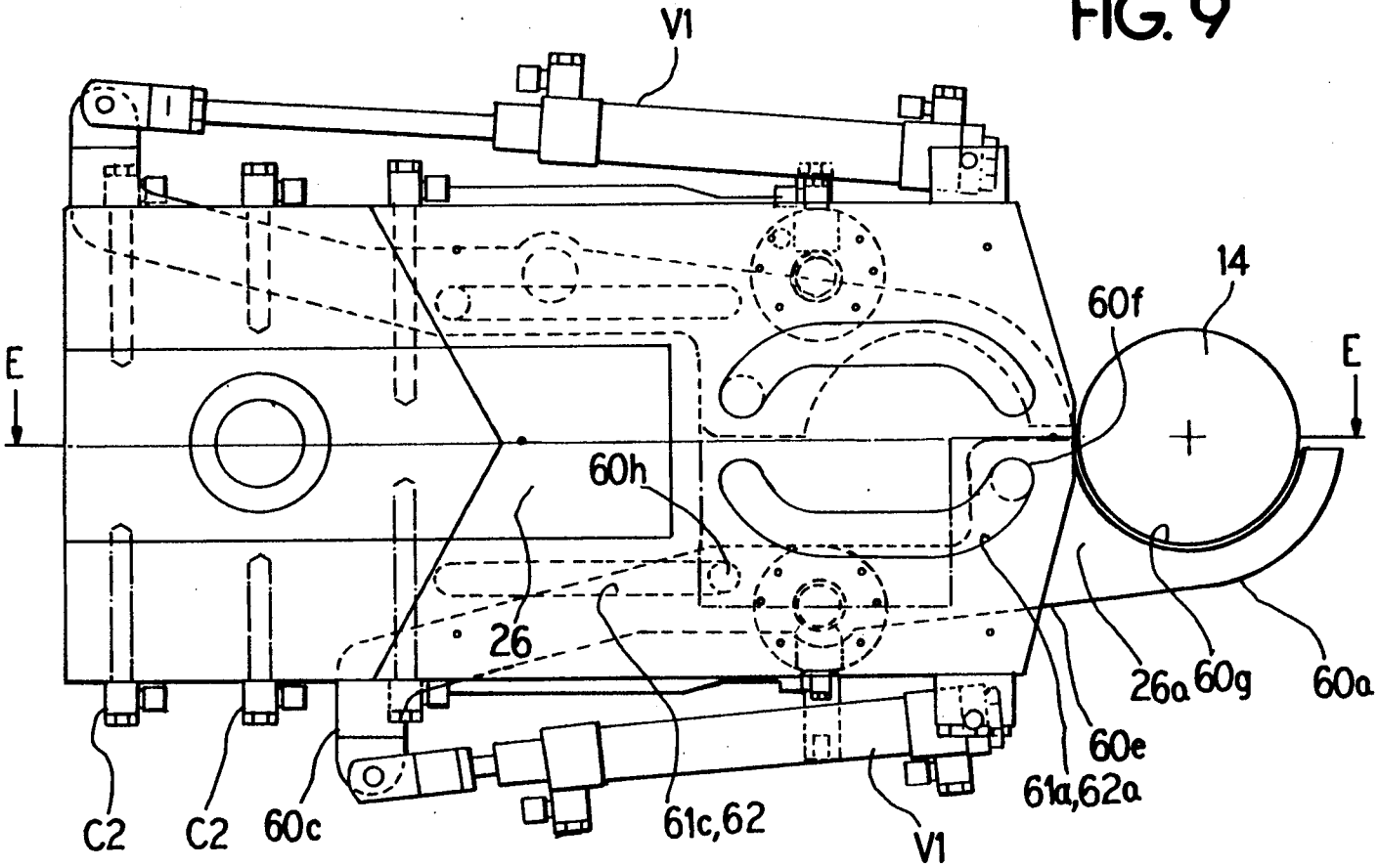
FIG. 9 is a view according to section line C—C of FIG. 8.
Figure 10:
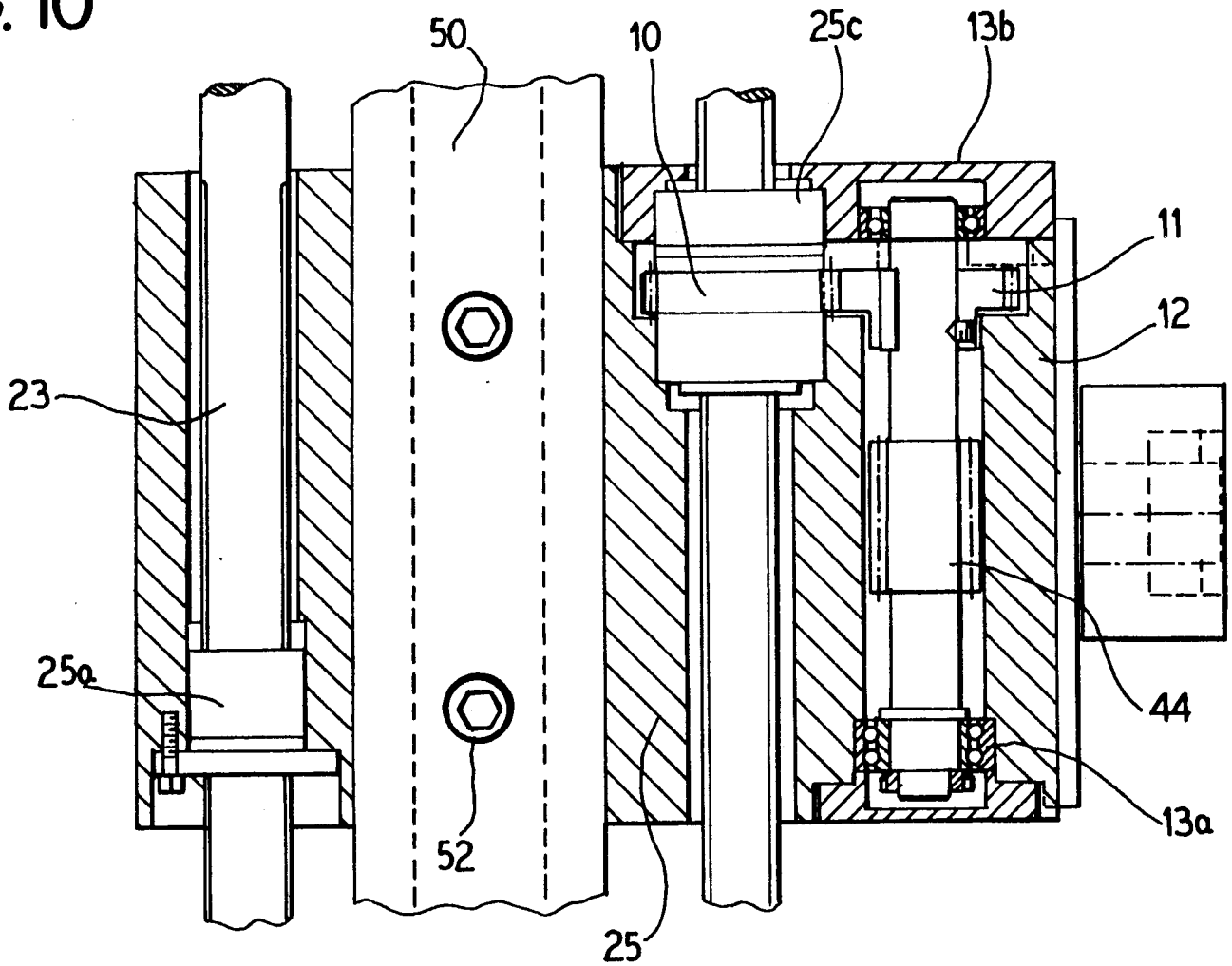
FIG. 10 is a sectional view according to section line A—A of FIG. 8.
Figure 11:
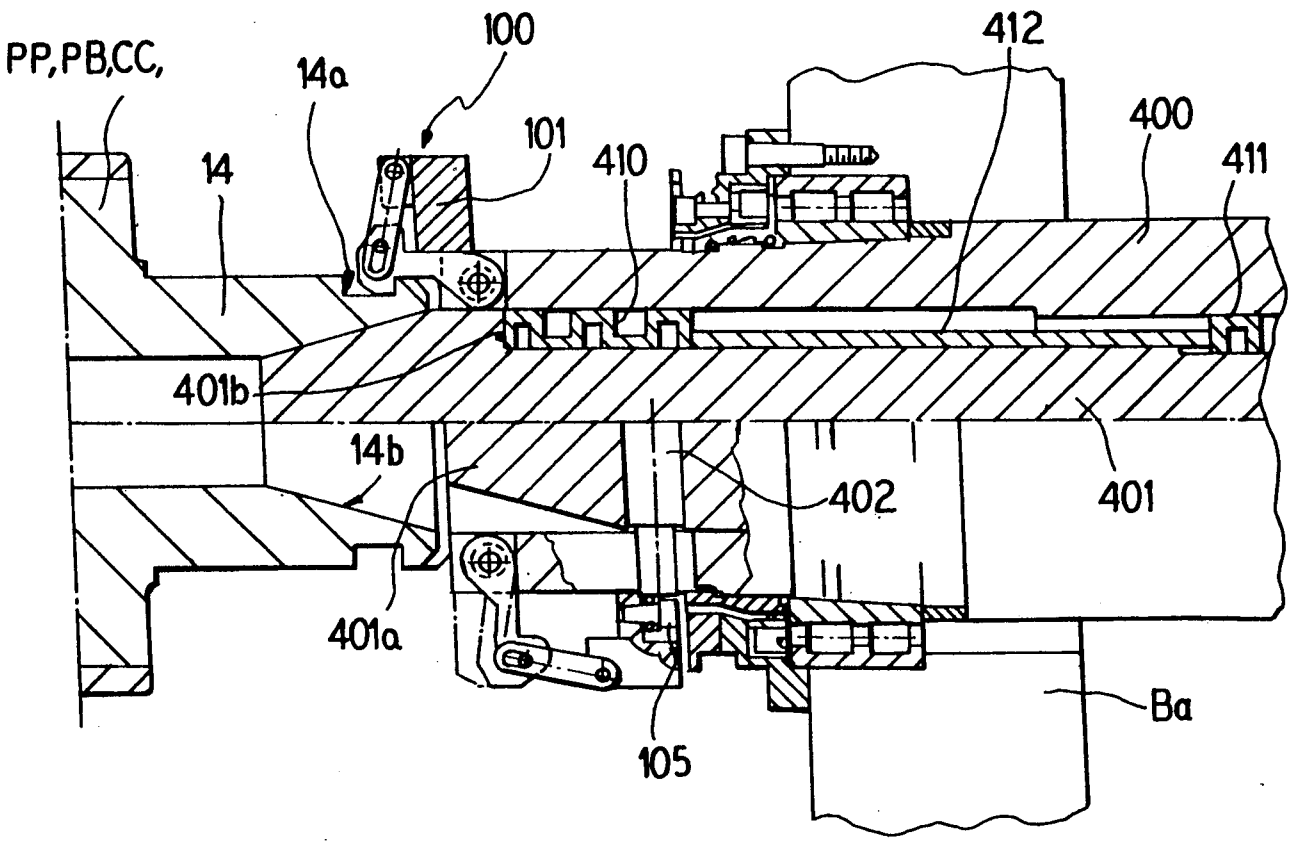
FIGS. 11 and 11A to 11D are sectional views illustrating a way of fitting the ends of a printing cylinder in an offset machine.
Figure 11A:
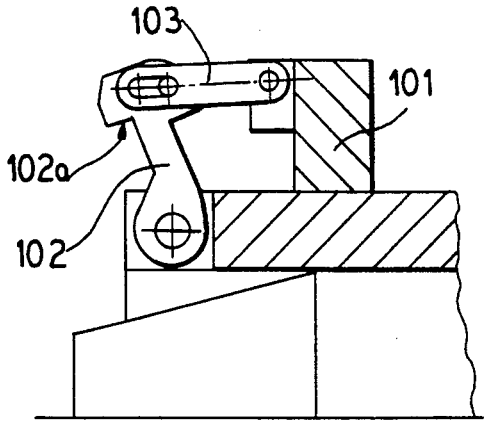
Figure 11B:
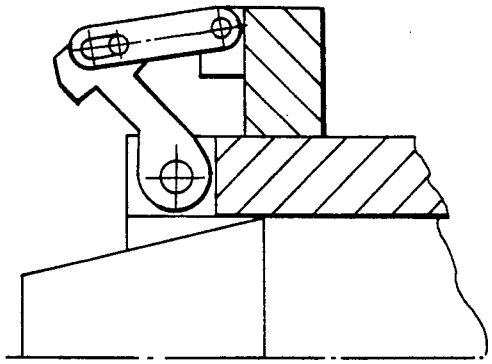
Figure 11C:
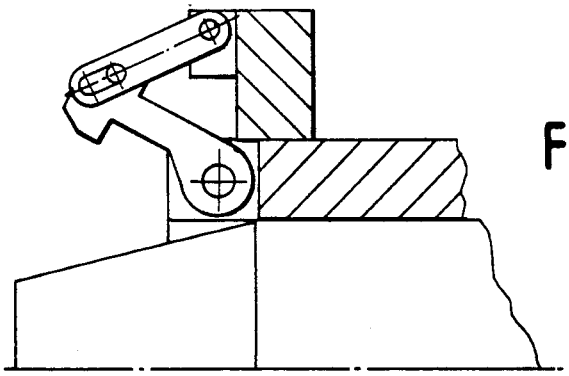
Figure 11D:
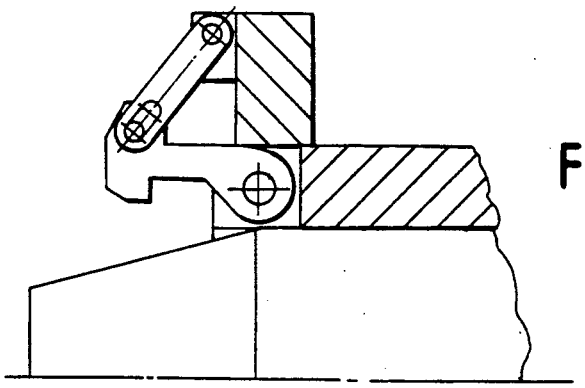

FIGS. 8 to 10 show the conception of the tilting arm 26 and its control means. In this connection also, only one side will be described since the other side is of identical design.

The movable support 25 is fitted so as to be able to be shifted vertically along and outside a right-angle corner-piece of the frame Ba of the unit $G_2$. For this purpose, the movable support 25, if viewed from the top, has the shape of a right-angle block taking up the shape of, though without entering into contact with, the corner of the frame Ba. The movable support 25 is provided with a guiding groove 51 connected with a corresponding vertical rail 50 fitted downstream on the frame Ba by means of screws 52. The vertical shift of the support 25 is thus ensured, as mentioned above, by the ball-bearing supported screws 23 engaged with the corresponding nut 25*a* (see FIG. 10). One end of the arm 26 is fitted on a horizontal axle 80 arranged perpendicularly to the lateral side of the frame Ba and fitted so as to be able to rotate with the bearings 81 on the movable support 25. The arm 26, whose thickness is reduced to a minimum for insertion ease into the narrow space situated between the end of the cylinder PP, PB, or CC and the spindle 100 holding it on the printing unit $G_2$, consists of a first and a second plate 61 and 62 respectively of identical shape and held parallel to, and at a certain distance from, one another by a third intermediate plate 60. The three plates 60–62 can be fitted together to form a resistant assembly with the shape of an arm 26 by means of any known means, for instance welding. The rotation of the arm 26 on the axle 80 can be interlocked by means of a known cone system with compression screw 84, resulting in a friction coupling.

The intermediate plate 60 is shorter than the two other plates 61, 62 so as to leave between the free end of the latter plates a free space which can be occupied by two movable lower and upper grippers 26*a*. Both these grippers 26*a* are of exactly identical, though symmetrical, design with respect to each other (see FIG. 9). This ensures an exactly simultaneous operation even if, as shown by FIG. 9, the lower gripper 26*a* is shown for easier understanding with its end 60*a* exceeding the free end of the two plates 61, 62, i.e. of the arm 26, and being connected to the central shaft 14 of the cylinders by means of a semi-circular recess 60*g* open upward. Every gripper 26*a* has the shape of a plate with a slightly lesser thickness than the intermediate plate 60 so as to be able to freely slide between the two other plates 61, 62. This gripper 26*a* thus consists of the front part 60*a* with a recess 60*g*, of a rear part 60*c* and a central part 60*e*. The central part 60*e* includes two guiding trunnions 60*f*, 60*h* designed so as to be engaged in the corresponding grooves 61*a*, 62*a* and 61*c*, 62*c* respectively of the two plates 61, 62. The shape and the arrangement of the gripper 26*a*, the grooves 61*a*, 62*a*, 61*c*, 62*c*, and the trunnions 60*f*, 60*h* are such that, with the gripper 26*a* shifted forward by a jack $V_1$ whose output rod is engaged in the rear part 60*c* of the gripper 26*a*, the recess 60*g* will be able to be connected with the lower or upper half of the shaft 14. It is to be noticed that the arm 26 has been shaped in such a way that its free end, i.e. the one of the two plates 61, 62, will be located in the very vicinity of the shaft 14 without getting in contact with the shaft 14, whatever its tilting rate will be. Once the notch 60*g* is connected with the shaft 14, a movable locking trunnion 90 closed by a spring 91 and opened by a pneumatic jack $V_2$ (the latter being mounted on the first plate 61) is engaged in a corresponding aperture 60*m* of the gripper 26*a*. At this stage, for instance in the event of an unloading operation, the spindle 100, which is engaged with the end of shaft 14 in the printing unit $G_2$, is axially shifted so as to disengage the latter shaft with respect to the printing unit $G_2$, and to let the weight of the cylinder PP, PB, or CC rest immediately on the arm 26.

In order to enable the arm 26 to rotate by an unlimited amount, the system providing the jack $V_1$ with pneumatic fluid includes a rim 70 consisting of rotary seals and which is arranged concentrically on the axle 80. The fixed rim 70 has numerous orifices 71 connected to a pneumatic fluid supply duct $C_1$ and to ducts 64 with holes inside the first rotary plate 61. The ducts 64 exceeding the free edge of the plate 61 are then connected to the four pneumatic jacks $V_1$, $V_2$ through appropriate ducts $C_2$. The rim 70 is fitted on a lid 74 arranged concentrically on the axle 80 and fitted on the movable support 25 by means of screws 75. As may be gathered from FIG. 8, the lid 74 also has, for the purpose of ensuring axial fastening of the axle 80 inside the movable support 25 in a joint design comprising a snap ring 86, a first bearing 81, a washer 87, a toothed rim 88 (to be described hereafter), a thrust rim 82 and a second bearing 81 (fitted on the lid 74). The rim 70 is pressed against the arm 61 only if the latter is being stopped, since for that action exclusively the jacks are to be put to operation. When the arm rotates, all pressures are cut, thus preventing the seals of the rim from getting worn.

The means for driving the axle 80 include a first pinion 10 (see FIG. 10) fitted on the nut 25*c* and connected to a second, stationary, pinion 11 permanently fitted on the axle 12. The rotary axle 12, of which the ends are fitted into ball-bearings 13*a*, 13*b* of the movable support 25 for free rotation, bears a drive worm 14 connected with the toothed rim 88 fitted for simultaneous rotation on the axle 80 by means of pins 82*a* engaged in the arresting piece 82.

Obviously, the execution of the arm 26 described above has been shown only as an example, numerous variations being envisionable. Hence, the arm 26 can be made of a single plate in which a free space is prepared for the grippers 26*a*. In cases requiring no complete revolution of the arm 26, the supply of pneumatic fluid to the jacks can be ensured through the hoses directly, i.e. without making use of the rotary rim with seals. The control of the grippers 26*a* might be electrical, etc.

The arrangement shown as an example has the advantage of being self-locked in case of pneumatic or electrical break-down. Moreover, it has been designed as compact as possible.

FIGS. 11 and 11A to 11D show an example of a design of the spindle 100 bearing the cylinders PP, PB, CC in a printing unit $G_1$–$G_4$. The spindle 100 consists of a rim 101 with pairs of jointed connecting rods 102, 103 angularly arranged around the axle of the shaft 14 of a cylinder PP, PB, CC. The assembly consisting of the rim 101 and the connecting rods 102, 103 is shiftable between a first position (represented in the upper half of FIG. 11) in which a hook-shaped part 102*a* of a connecting rod 102 is engaged in a corresponding groove 14*a* of the shaft 14, and a second position (shown in the lower half of FIG. 11) in which the connecting rods 102, 103 are sufficiently distant from the shaft 14 to allow the removal of the cylinders PP, PB, CC, as described above. For achieving the shift of the connecting rods 102, 103, the one with identification number 103 is joined to the rim 101 and the other, 102, to a cylinder 400 fitted for rotation into the frame Ba of the machine. The axle of the cylinder 400 is identical with the axle of the shaft 14. Inside the cylinder 400 a shaft 401 is fitted which is shiftable by means of a jack situated on the side of the non-visible end of the cylinder 400 between the two positions illustrated by FIG. 11, i.e. between a first position in which a tapered end 401*a* exceeds the cylinder 400 and is connected to a corresponding tapered part 14*b* of the shaft 14, and a second position in which the tapered end 401*a* is fully retracted into the cylinder 400. The rim 101 fitted concentrically and for sliding with respect to the cylinder 400, is fitted with screws 105 on a trunnion 402 passing through and being connected to the inner shaft 401 so as to be able to simultaneously shift the shaft 401 and the rim 101. FIGS. 11A to 11D show the various positions of the connecting rods 102, 103 with respect to the position of the rim 101. Summing up, it is permissible to say that the tapered parts 401, 14*b* make up a radial linkage, and the hooks 102*a* together with the groove 14*a* an axial linkage, between the shaft 14 and the cylinder 400.

A peculiarity consists in the fact that the pushing force putting the tapered parts 401*a*, 14*b* into connection is not applied on the shaft 401 in a direct way, but first on a special bushing 411, on the intermediate piece 412, on the bushing 410, and then only on the shaft 401 through the shoulder 401*b*. When the tapered part 401*a* is stopped in its advance by the tapered part 14*b* which is part of the shaft 14 retained by the hooks and the cylinder 400*k*, the pushing force maintained so far results in causing a concentric radial thickening of the bushings 410, 411, thus eliminating the radial backlash necessary to the axial shifting. The end of the cylinder 400 subjected to possible radial dilatation will be stiffened by the rim 101.

The whole assembly is thus a backlash-free body. Inversely, with a pulling force applied this time directly on the shaft 401, the bushings 410, 411 will take their initial shape resulting in a small radial backlash between the parts 400/411 and 400/410.

Although various minor changes and modifications might be proposed by those skilled in the art, it will be understood that I wish to include within the claims of the patent warranted hereon all such changes and modifications as reasonably come within my contribution to the art.

I claim as my invention:

1. A web-fed offset printing machine for variable operating sizes, comprising:

at least one printing unit formed of a fixed frame having plate, blanket, and counter printing cylinders arranged substantially vertically with the plate cylinder in a top position, the frame being designed to accommodate the cylinders with varying diameters for varying printing sizes;

an upper movable cassette receivable on the fixed frame and having an inking station with a corresponding ink well, dipping rollers, distributing rollers, and inking rollers, means being provided for locating the cassette at a lower position in which the inking rollers can be in contact with a plate cylinder of a desired minimum size and an upper position in which the inking rollers are sufficiently set off from the plate cylinder to enable loading and unloading of the plate cylinder, blanket cylinder, and counter cylinder of a desired maximum size; and movable means on both sides of the fixed frame for engagement with respective opposite ends of a central shaft of the cylinders on the printing unit for unloading the printing unit cylinders and placing them on supporting bars situated in a downstream vicinity of the printing unit and for loading different sized cylinders from the supporting bars onto the printing unit.

2. A machine according to claim 1 including means for controlling the unloading of the cylinders from the printing unit and the loading of the different sized cylinders onto the printing unit.

3. A machine according to claim 1 wherein the cassette includes a moistening unit with an associated basin, dipping rollers, distributing rollers, and moistening rollers, and wherein the locating means permits the moistening rollers to be in contact with a plate cylinder of the minimum size in the cassette lower position and in the upper position a sufficient set-off is provided between the moistening rollers and the plate cylinder to enable loading and unloading of the maximum size plate cylinder, blanket cylinder, and counter cylinder.

4. A machine according to claim 1 wherein the fixed frame has fitted thereon a means for washing the blanket cylinder.

5. A machine according to claim 1 comprising:

said movable means comprising opening and closing telescopic grippers situated at a free end of at least one tilting arm with the other end of the tilting arm being connected to pivot on a horizontal axis on a movable support means for substantially vertical movement along guides attached to the fixed frame, said movable support means with the attached tilting arm and grippers moving the cylinders for the new printing size up to a vicinity of and at a level of a position of the original cylinders on the printing unit such that said grippers can unload the cylinders operating on the printing unit and to load the different size cylinders; and said supporting bars situated in the downstream vicinity of the printing unit being part of an independently shiftable carriage having means for permitting movement of the carriage substantially perpendicularly to a travelling direction of the web.

6. A machine according to claim 5 further including:

a vertical ball-bearing supported rotatable screw means for providing a vertical shift of each of said movable support means along said respective guides of the fixed frame, each of said vertical ball-bearing supported screw means engaging with a corresponding nut mounted on each respective movable support means so that rotation of the two ball-bearing supporting screw means causes vertical shift of each of the movable support means, and further including a single motor means for providing a rotation of both of the two ball-bearing supported screw means for effectuating a simultaneous and substantially identical shifting and positioning of the two corresponding movable support means along the corresponding guides; and a vertical rotational shaft means for tilting each of said tilting arms by engagement with means on each movable support means for transforming a rotational motion of the vertical shaft means into a tilting motion of the respective tilting arm around a horizontal axle, and wherein a single motor means imparts rotational drive to both of the vertical shaft means at each side of the fixed frame for effecting a simultaneous and identical tilting motion of the two corresponding tilting arms.

7. A machine according to claim 6 wherein said means for converting rotation of the vertical shaft means into a rotary motion of the axle on which the respective tilting arm is mounted includes a first toothed pinion fitted on the vertical shaft means engaging with a second toothed pinion mounted on a vertical rotary axle provided with a drive worm pinion engaging a toothed rim mounted on the horizontal axle to which the respective tilting arm is mounted.

8. A machine according to claim 5 further including:

said carriage having a horizontal base with a length approximately equal to one of the printing cylinders, and wherein said means for substantial perpendicular movement comprises pivotable wheel means and means for shifting with a pallet transporter;

said carriage further comprising a vertical stay mounted at one end of the horizontal base; and said carriage comprising at least three horizontal supports vertically spaced parallel to the base and mounted at their one ends on the vertical stay and having mounted thereon said supporting bars, said supporting bars each having an upward recess means for providing a seat for a corresponding end of the central shaft of the respective printing cylinder, and wherein said horizontal supports are positioned at spaced vertical positions such that the plate cylinder, blanket cylinder, and counter cylinder will occupy a position situated above or underneath the web.

9. A machine according to claim 8 further including in addition to supporting bars for the plate cylinder, blanket cylinder, and counter cylinder, an auxiliary support means is also provided as an intermediate waiting area for one of the printing cylinders during loading and unloading of the cylinders.

10. A machine according to claim 9 wherein the auxiliary support means is mounted on the printing unit.

11. A machine according to claim 9 wherein the auxiliary support means is mounted on the carriage.

12. A machine according to claim 8 wherein the carriage has a web passage opening between the base and bottom most horizontal support holding the counter cylinder.

13. A machine according to claim 9 wherein the auxiliary support means is supported above all three printing cylinders and an additional auxiliary support means is provided underneath all three printing cylinders.

14. A machine according to claim 1 wherein the blanket cylinder is arranged on a fixed mount within the printing machine, and the plate and counter cylinders are mounted at one end of respective tilting levers, an opposite end of the tilting levers being connected to rotate around a respective horizontal axle on the fixed frame.

15. A machine according to claim 5 wherein the tilting arm is formed of at least one plate whose one end pivots around an axle and wherein a free end thereof is provided with said grippers having means for preventing contact with the central shaft of the printing cylinders when the gripper occupies a first position with the arm tilting and wherein in a second position they can engage with the central shaft of the cylinders.

16. A machine according to claim 15 wherein the grippers are each provided with guiding means engaged with a corresponding means which is part of the tilting arm for ensuring during passing over from the first to the second position that the guiding, opening, and closing of the two grippers is provided for, and locking means being provided for locking the two grippers in position with respect to the tilting arm when they are connected to the central shaft of the cylinders.

17. A machine according to claim 16 wherein pneumatic jack means are provided for movement and locking of the grippers.

18. A machine according to claim 17 wherein a rotary seal means concentric to the pivoting axle is provided for distribution of pneumatic fluid for conduits in the tilting arm and for the pneumatic jacks.

19. A machine according to claim 1 wherein the printing unit has retractable means for acting as a rotary support for each end of a central shaft of the plate cylinder, blanket cylinder, and counter cylinder, said retractable means comprising:

a rotary cylinder member fitted on the fixed frame of the printing unit;

a shaft means within the rotary cylinder member for shifting between a first position in which one of its ends protrudes from the cylinder member and is radially connected with a corresponding part of the cylinder central shaft and a second position in which said one end is disengaged by axial shifting from the cylinder central shaft;

engagement means shiftable together with said shaft means between a first position in which the engagement means engages with corresponding engagement receiving means on the central shaft of the cylinder, and a second position in which the engagement means is disengaged from the central shaft of the cylinder; and means for radial backlash compensation comprising two bushings undergoing concentric distension under effect of an axial thrust for compensating radial backlash in a reversible way.

20. A printing machine for variable operating sizes, comprising:

at least one printing unit formed of a fixed frame having first, second, and third printing cylinders arranged substantially vertically, the frame being designed to accommodate the cylinders with varying diameters for varying printing sizes;

a movable carriage adjacent to the printing unit and having support arms storing first, second, and third cylinders of a different size than the cylinders in the printing unit; and movable tilt arm means on each side of the fixed frame for engagement with respective opposite ends of a central shaft of the cylinders on the printing unit for unloading the printing unit cylinders and placing them on said support arms of the carriage and for loading different sized cylinders from the support arms onto the printing unit.

21. A machine according to claim 20 wherein an auxiliary storage position means is provided at the printing unit for temporary placement of one of the cylinders with the movable tilt arm means during loading or unloading.

* * * * *